US008800342B2

(12) United States Patent
Chauncey

(10) Patent No.: US 8,800,342 B2
(45) Date of Patent: Aug. 12, 2014

(54) METHOD OF PREPARING A METALLIC TAPE FOR USE ON A JOINT

(76) Inventor: Edward W. Chauncey, St. Amant, LA (US)

( * ) Notice: Subject to any disclaimer, the term of this patent is extended or adjusted under 35 U.S.C. 154(b) by 0 days.

(21) Appl. No.: 13/570,094

(22) Filed: Aug. 8, 2012

(65) Prior Publication Data

US 2012/0297850 A1 Nov. 29, 2012

Related U.S. Application Data

(62) Division of application No. 13/081,284, filed on Apr. 6, 2011.

(51) Int. Cl.
*B21D 13/04* (2006.01)

(52) U.S. Cl.
USPC ..... 72/379.6; 72/185; 72/385

(58) Field of Classification Search
USPC ..... 72/306, 307, 379.6, 379.2, 385, 72/190–198, 252.5, 185, 203; 83/879, 83/881; 492/1, 28, 30, 33, 36
See application file for complete search history.

(56) References Cited

U.S. PATENT DOCUMENTS

| | | | | |
|---|---|---|---|---|
| 7,073 | A * | 2/1850 | Montgomery | 72/132 |
| 3,525,138 | A * | 8/1970 | Abbott | 72/326 |
| 3,777,530 | A * | 12/1973 | Jansson | 72/203 |
| 4,319,473 | A * | 3/1982 | Franke et al. | 72/196 |
| 6,834,420 | B1 * | 12/2004 | Rothe et al. | 72/391.8 |
| 2005/0230034 | A1 * | 10/2005 | Arora et al. | 156/229 |
| 2006/0261029 | A1 * | 11/2006 | Casini et al. | 215/355 |
| 2008/0313906 | A1 * | 12/2008 | Eisele | 72/6.2 |
| 2010/0112294 | A1 * | 5/2010 | Fidan | 428/163 |
| 2011/0041338 | A1 * | 2/2011 | Day et al. | 29/890.03 |

* cited by examiner

*Primary Examiner* — Edward Tolan
*Assistant Examiner* — Pradeep C Battula
(74) *Attorney, Agent, or Firm* — Superior IP, PLLC; Dustin L. Call

(57) ABSTRACT

One example embodiment includes a method of preparing a metallic tape for use on a joint. The method includes providing a metallic tape. The metallic tape includes a metallic carrier material and an adhesive layer. The metallic tape also includes a backing, wherein the backing material is configured to protect the adhesive layer until use. The method also includes creating alternating ridges and troughs along the width of the metallic tape. The method further includes creating a fold line along the length of the metallic tape, wherein the fold line includes an area lacking the alternating ridges and troughs. The method additionally includes cutting the backing along the fold line, wherein cutting the backing includes at least partially cutting through the backing on the metallic tape.

8 Claims, 5 Drawing Sheets

METHOD OF PREPARING A METALLIC TAPE FOR USE ON A JOINT

CROSS-REFERENCE TO RELATED APPLICATIONS

This application claims the benefit of and priority to U.S. Provisional patent application Ser. No. 13/081,284 filed on Apr. 6, 2011, which application is incorporated herein by reference in its entirety.

BACKGROUND OF THE INVENTION

Heating and air-conditioning ducts and other similar structures are often made to be easily assembled. In particular, they are constructed such that the pieces fit together rather easily, so that they can be put in the correct configuration rather quickly. However, while the fittings are often easy to fit to one another, they do not automatically seal. Instead, when a seal is needed, metallic tape is placed around the joint.

The seal can be quite important to the correct operation of the ducts. In particular, an unsealed joint can allow for leaks. The leaks, in turn, reduce the overall efficiency of the system. Further, the leaks can be dangerous if the system is carrying a gas that is toxic or can have harmful effects. Therefore, it is important that the seal be sufficient to prevent any leaks.

Metallic tape is convenient for a number of reasons. In particular, it is relatively cheap, it can be much cheaper than soldering the joint or other sealing methods. Additionally, the metallic tape can be easily obtained. Many stores carry the tape and it can easily be purchased in bulk. Further, the tape comes in rolls, which allows a significant amount of tape to be transported to the site where the joint which needs to be sealed is located.

Nevertheless, there are a number of problems in sealing a joint with metallic tape. The tape is easily applied if the joint is straight. However, if the joint is not straight, the tape tends to bunch up. That is, as the tape is applied to a curved joint, the "longer" edge lies flat but the "shorter" edge results in tape that is struck to itself in irregular patterns, which means that the seal is weak or incomplete.

To compensate for this, the user often tapes over the non-flat edge, sometimes to several layers thick, to ensure that a seal is established. This is wasteful and can make modifications or repairs to the system more time intensive. Alternatively, the user can cut partway across the width the tape where the tape will be applied to the non-straight joint. This can allow the tape to fold flat. However, it is often a case of trial and error to make the cuts in the correct position. Additionally, this can weaken the seal created by the tape.

Accordingly, there is a need in the art for a system which can properly seal a joint, even if the joint is not straight. Additionally, there is a need in the art for the system to work with metallic tape. Further, there is a need in the art for the system to properly prepare the metallic tape relatively quickly.

BRIEF SUMMARY OF SOME EXAMPLE EMBODIMENTS

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter.

One example embodiment includes a method of preparing a metallic tape for use on a joint. The method includes providing a metallic tape. The metallic tape includes a metallic carrier material and an adhesive layer. The metallic tape also includes a backing, wherein the backing material is configured to protect the adhesive layer until use. The method also includes creating alternating ridges and troughs along the width of the metallic tape. The method further includes creating a fold line along the length of the metallic tape, wherein the fold line includes an area lacking the alternating ridges and troughs. The method additionally includes cutting the backing along the fold line, wherein cutting the backing includes at least partially cutting through the backing on the metallic tape.

These and other objects and features of the present invention will become more fully apparent from the following description and appended claims, or may be learned by the practice of the invention as set forth hereinafter.

BRIEF DESCRIPTION OF THE DRAWINGS

To further clarify various aspects of some example embodiments of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION OF SOME EXAMPLE EMBODIMENTS

Reference will now be made to the figures wherein like structures will be provided with like reference designations. It is understood that the figures are diagrammatic and schematic representations of some embodiments of the invention, and are not limiting of the present invention, nor are they necessarily drawn to scale.

Figure 1:
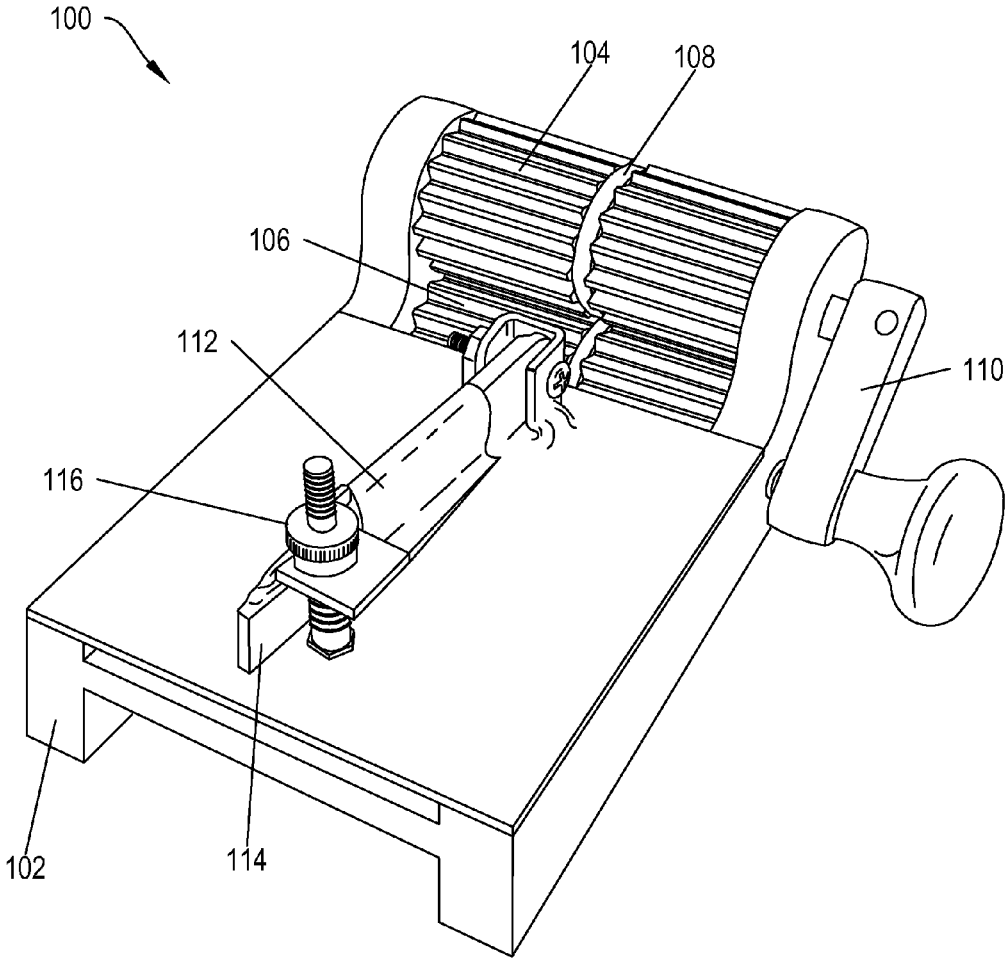
FIG. 1 illustrates a perspective view of an example of a system for corrugating a metallic tape.

FIG. 1 illustrates a perspective view of an example of a system 100 for corrugating a metallic tape. In at least one implementation, the corrugations can include alternating ridges and troughs along the width of the metallic tape. The corrugations can allow the metallic tape to be folded to better accommodate the taping of joints, as described below.

FIG. 1 shows that the system 100 can include a body 102. In at least one implementation, the body 102 can be used to guide the metallic tape. In particular, the body 102 can ensure that the tape is aligned properly in order to ensure that the corrugations are along the width of the metallic tape. Additionally or alternatively, the body 102 can be used to secure the other portions of the system 100. The body 102 can be made of any suitable material. For example, the body 102 can be made of wood, metal, plastic or any other suitable material.

FIG. 1 also shows that the system 100 can include a first gear 104. In at least one implementation, the first gear 104 can include a wheel or shaft with teeth or cogs extending from the outer surface at regular intervals. The teeth can produce the corrugations in the metallic tape, as described below. The first gear 104 can be mounted on the body 102. The first gear 104 can be made of any suitable material. For example, the first gear 104 can be made of wood, metal, plastic or any other suitable material.

FIG. 1 further shows that the system 100 can include a second gear 106. In at least one implementation, the second gear 106 can be mounted on the body 102 and can mate with the first gear 104. The pressure of the first gear 104 mating with the second gear 106 can form corrugations along the metallic tape. I.e., metallic tape inserted between the first gear 104 and the second gear 106 can be reshaped, such that the metallic tape becomes corrugated, as described below. The second gear 106 can be made of any suitable material, such as the same material as the first gear 104. Additionally or alternatively, the second gear 106 can be made of different material that the first fear 104.

One of skill in the art will appreciate that mating between the first gear 104 and the second gear 106 need not include the teeth of the first gear 104 interacting with the teeth of the second gear 106, either directly or indirectly. I.e., the outside circle of the first gear 104 need not intersect the outer circle of the second gear 106. However, the first gear 104 and second gear 106 can be aligned such that if the outside circle of the first gear 104 did intersect the outer circle of the second gear 106, then the teeth of the first gear 104 and the second gear 106 would mesh In at least one implementation, the clearance between the first gear 104 and the second gear 106 can be sufficient to accommodate the metallic tape. As used herein the clearance between the first gear 104 and the second gear 106 can be the closest distance between the root circle (i.e., the circle circumscribed by the base of the teeth) of the first gear 104 and the root circle of the second gear 106. I.e., the clearance between the first gear 104 and the second gear 106 can be the distance from the center of the first gear 104 to the center of the second gear 106 minus the root radius of the first gear 104 and the root radius of the second gear 106. The clearance can be a fixed distance or can be determined by a force that forces the first gear 104 and the second gear 106 toward one another. For instance, the clearance between the first gear 104 and the second gear 106 can be between 0.01 inches and 0.02 inches. In particular, the clearance between the first gear 104 and the second gear 106 can be approximately 0.015 inches. As used in the specification and the claims, the term approximately shall mean that the value is within 10% of the stated value, unless otherwise specified.

In at least one implementation, the diameter of the first gear 104 and the second gear 106 can be any convenient value to create the proper circular pitch. In particular, the circular pitch is the distance from one face of a tooth to the corresponding face of an adjacent tooth on the same gear. The circular pitch can determine the distance between adjacent troughs in the corrugated metallic tape. For example, the circular pitch of the first gear 104 and/or the second gear 106 can be between 0.1 inches and 0.2 inches. In particular, the circular pitch of the first gear 104 and/or the second gear 106 can be approximately 0.15 inches.

FIG. 1 additionally shows that the first gear 104 and/or the second gear 106 can include an interior portion 108. I.e., the first gear 104 and/or the second gear 106 can include an interior portion 108 which lacks teeth. For example, the interior portion 108 can include an area where the teeth are completely lacking. Additionally or alternatively, the interior portion 108 can include a filling that prevents corrugations from forming or flattens the corrugations as they form. For example, the interior portion 108 can include cork, rubber, plastic or other material. The filling can fill a only a portion of the interior portion 108, allowing the first gear 104 and the second gear 106 to continue to rotate relative to one another. For example, the filling can occupy approximately 50 percent of the gap between the bottom of the teeth and the top of the teeth.

One of skill in the art will appreciate that the interior portion 108 can be at the midpoint of the first gear 104 and/or the second gear 106. In at least one implementation, the smooth interior portion 108 can be used to produce a fold line in the metallic tape, as described below. The interior portion 108 of the first gear 104 and the interior portion 108 of the second gear 106 can be opposite one another.

One of skill in the art will appreciate that the first gear 104 and/or the second gear 106 can each include one or more gears combined, such that the junction between gears forms the interior portion 108. I.e., the interior portion 108 can be a junction between gears, rather than a portion of a single gear which lacks teeth.

FIG. 1 also shows that the system 100 can include a turning mechanism 110. In at least one implementation, the turning mechanism 110 can be attached to the first gear 104. I.e., the turning mechanism 110 can be used to turn the first gear 104. The mating of the first gear 104 and the second gear 106 can impart the rotational force applied by the turning mechanism 110 applied to the first gear 104 to the second gear 106, turning the second gear 106. Additionally or alternatively, the turning mechanism 110 can be attached to the second gear 106 for turning the second gear 110.

One of skill in the art will appreciate that the turning mechanism 110 can include any mechanism, device or apparatus which provides rotational force. For example, the turning mechanism 110 can include an arm and handle. Additionally or alternatively, the turning mechanism 110 can include a motor. A motor includes any device capable or transforming electrical or mechanical energy into rotational force.

FIG. 1 further shows that the system 100 can include a cutting mechanism 112. In at least one implementation, the cutting mechanism 112 is attached to the body 102 and is configured to at least partially cut through the backing of the metallic tape. Partially or completely cutting through the backing of the metallic tape can allow the backing to be removed, even when the tape has been folded, as described below.

FIG. 1 shows that the cutting mechanism 112 can include a blade 114. In at last one implementation, the blade 114 can include a flat cutting surface. In particular, the blade 114 can be the portion of the cutting mechanism which cuts through the backing of the metallic tape. One of skill in the art will appreciate that the blade 114 can be mounted directly on the first gear 104 or the second gear 106. For example, the blade 114 can be mounted on the smooth interior portion 108.

FIG. 1 also shows that the cutting mechanism 112 can include an adjustment mechanism 116. In at least one implementation, the adjustment mechanism 116 can be used to adjust the position of the blade 114 relative to the metallic tape as it passes through the system 100. I.e., if the adjustment mechanism 116 can move the position blade 114 to ensure that the blade neither cuts the backing too deeply nor too shallowly. For example, the adjustment mechanism 116 can include a spring, bolt and thumbnut.

Figure 2:
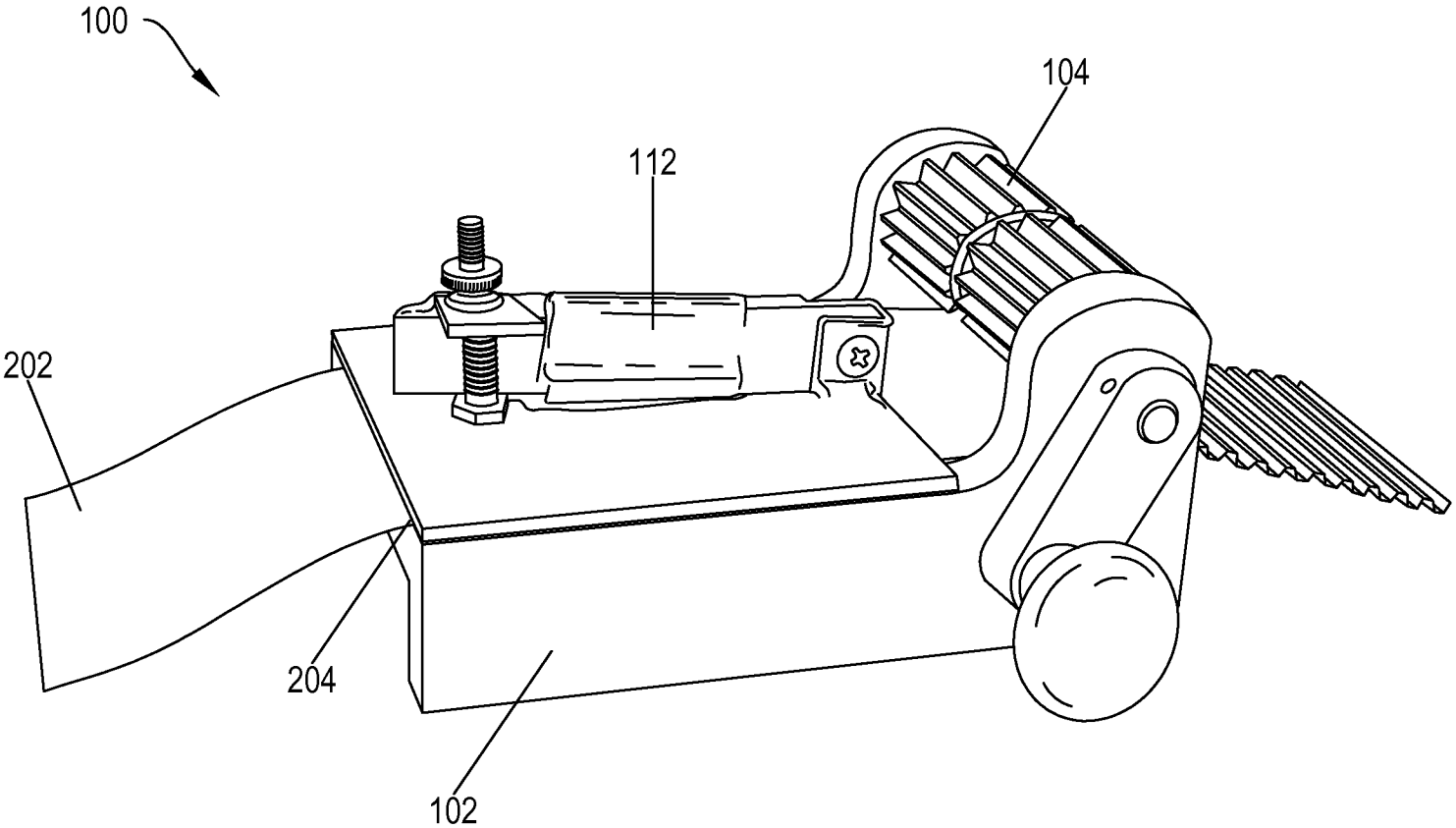
FIG. 2 illustrates an example of the system for corrugating a metallic tape in use.

FIG. 2 illustrates an example of the system 100 for corrugating a metallic tape in use. In at least one implementation, the system 100 can be portable. In particular, the system 100 can be light weight and/or compact in size. A portable system 100 can allow the user to take the system 100 to the work location and corrugate the metallic tape 202 as needed. I.e., the user can corrugate only the amount of metallic tape 202 needed for a particular application.

FIG. 2 shows that the body 102 can include a slot 204. In at least one implementation, the slot 204 can be configured to receive the metallic tape 202. In particular, the slot 204 can position the metallic tape 202 so that the cutting mechanism 112 cuts the backing of the metallic tape 202 at the proper position. Additionally or alternatively, the slot 204 can position the metallic tape 202 to be properly aligned relative to the first gear 104 and the second gear 106.

FIG. 2 also illustrates that the metallic tape 202 can pass through the clearance between the first gear 104 and the second gear. In particular, the rotation of the first gear 104 can pinch the metallic tape 202 along its length, producing the desired corrugations. The force of the metallic tape 202 passing through the clearance between the first gear 104 and the second gear 106 can rotate the first gear 104 and the second gear 106. Additionally or alternatively, the turning mechanism 110 can rotate the first gear 104 and/or the second gear 106 which pulls the metallic tape 202 through the slot 204 and past the cutting mechanism 112.

Figure 3:
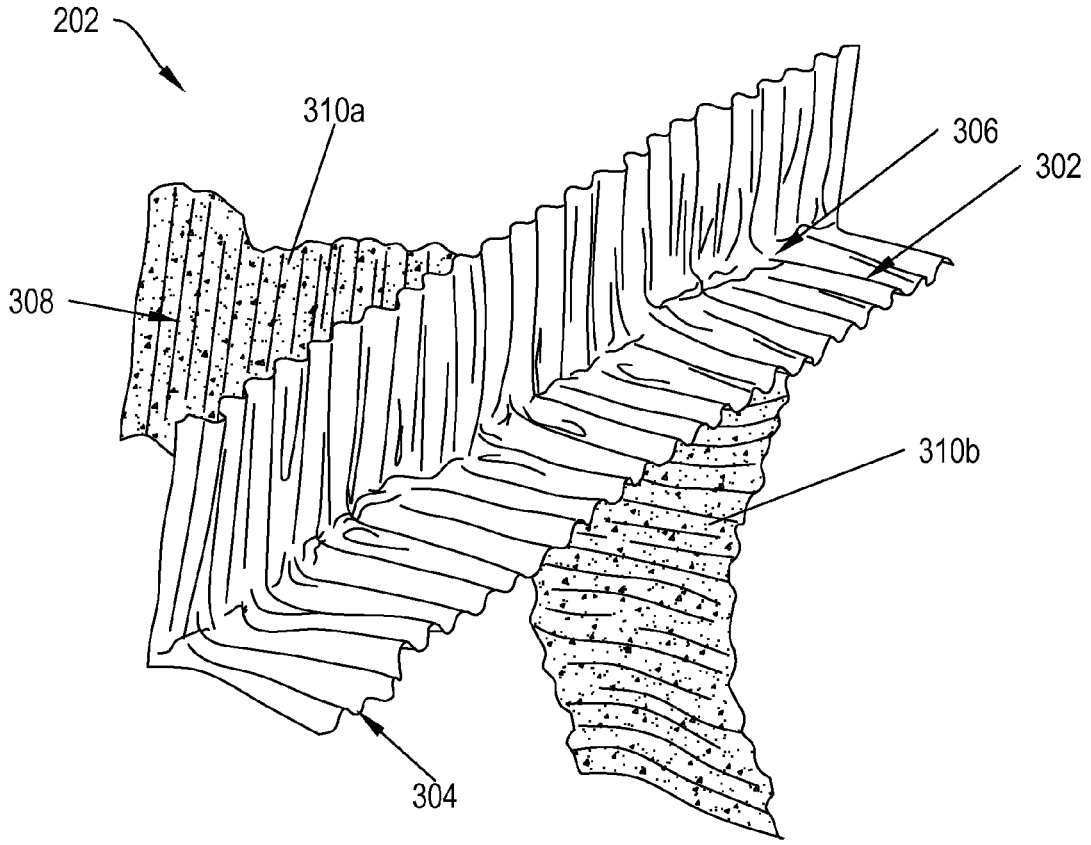
FIG. 3 illustrates an example of metallic tape which has been corrugated.

FIG. 3 illustrates an example of metallic tape 202 which has been corrugated. In at least one implementation, the corrugated metallic tape 202 is capable of taping joints that would otherwise require numerous cuts to accommodate. I.e., joints with severe angles are capable of being taped and sealed with the corrugated metallic tape 202.

FIG. 3 shows that the corrugated metallic tape 202 includes alternating ridges 302 and troughs 304. In at least one implementation, the ridges 302 and troughs 304 allow the tape a great deal of flexibility. In particular, certain sections of the metallic tape 202 can be lengthened, while others are unaffected. For example, the outer section can spread or "fan" by flattening the ridges 302 allowing the tape to curve. Where the ridges 302 remain, the adhesive of the metallic tape 202 can attach the "inside" of the ridge 302 to itself. I.e., an ascending side of the ridge 302 can be attached to the descending side of the ridge 302. This can produce at tight seal, even where the metallic tape 202 is not spread.

FIG. 3 also shows that the metallic tape 202 can include a fold line 306. In at least one implementation, the fold line 306 can allow the metallic tape 202 to be folded, allowing the metallic tape 202 to be used on adjacent structures, as described below. The fold line 306 can pass through the midline of the metallic tape 202. I.e., the fold line 306 can allow the tape to fold in half, with the portions on either side approximately equal in size. Additionally or alternatively, the fold line 306 can create sections that are of different size and/or more than two sections.

FIG. 3 further shows that the metallic tape 202 can include a backing 308. In at least one implementation, the backing 308 can be cut along the fold line 306. In particular, the backing 308 can be cut to produce a first section 320*a* and a second section 320*b* which are on opposite sides of the fold line 306. I.e., the first section 320*a* can be removed, allowing the metallic tape 202 on that side of the fold line 306 to be applied to the desired surface while the second section 320*b* can be used to protect the adhesive on the portion of the metallic tape 202 that is not ready to be used.

Figure 4:
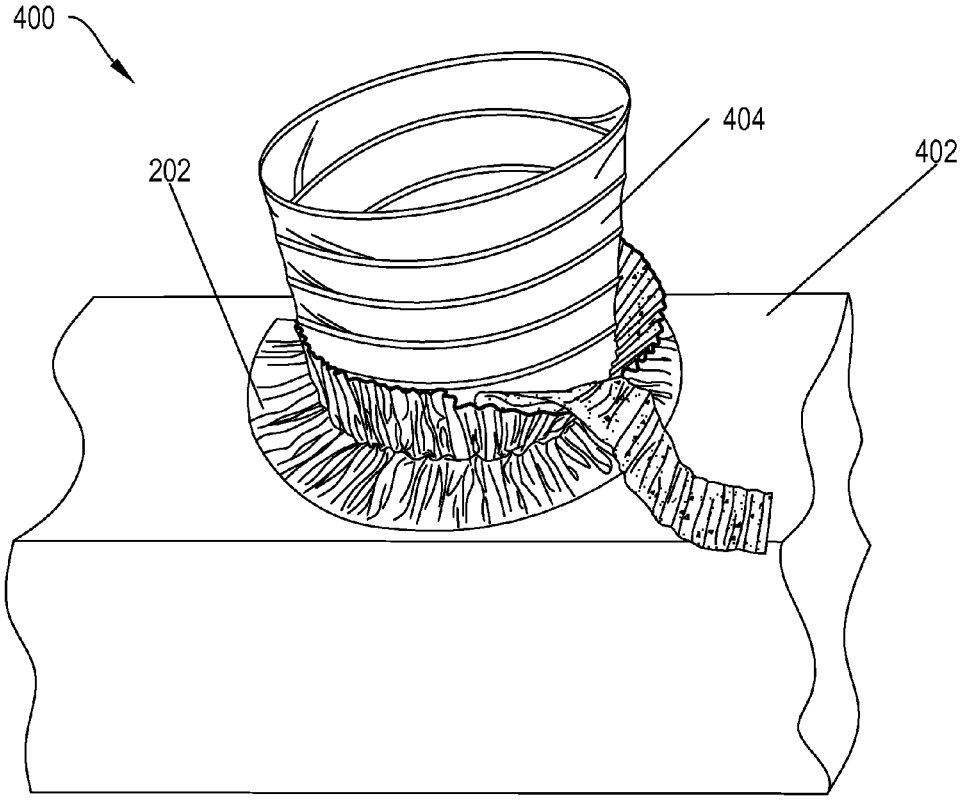
FIG. 4 illustrates an example of corrugated metallic tape being installed on an irregular joint.

FIG. 4 illustrates an example of corrugated metallic tape 202 being installed on an irregular joint 400. In particular, the metallic tape can be used on any joint 400 that in non-planar or that is substantially non-flat. I.e., flat metallic tape 202 is sufficient for taping joints where the sides of the joint 400 form a flat or substantially flat surface. In contrast, corrugated metallic tape 202 can be applied to a joint 400 which curve, have acute angles or are otherwise difficult to tape with flat tape.

FIG. 4 shows that the corrugated metallic tape 202 can be applied to a first surface 402. In at least one implementation, the first surface 402 can include a hole or other opening which forms the first portion of the joint 400. In the example joint 400, the first surface includes a round hole and the joint 400 extends perpendicularly from the first surface 402. The metallic tape 202 can be installed with the fold line around the hole and the outer edges of the metallic tape 202 spreading out to lie flat on the first surface 402.

FIG. 4 also shows that the corrugated metallic tape 202 can also be allied to a second surface 404. In at least one implementation, the second surface 404 include a hole or other opening which forms the second portion of the joint 400. In particular, the second surface 404 can include an opening which is configured to mate with the opening on the first surface.

Figure 5:
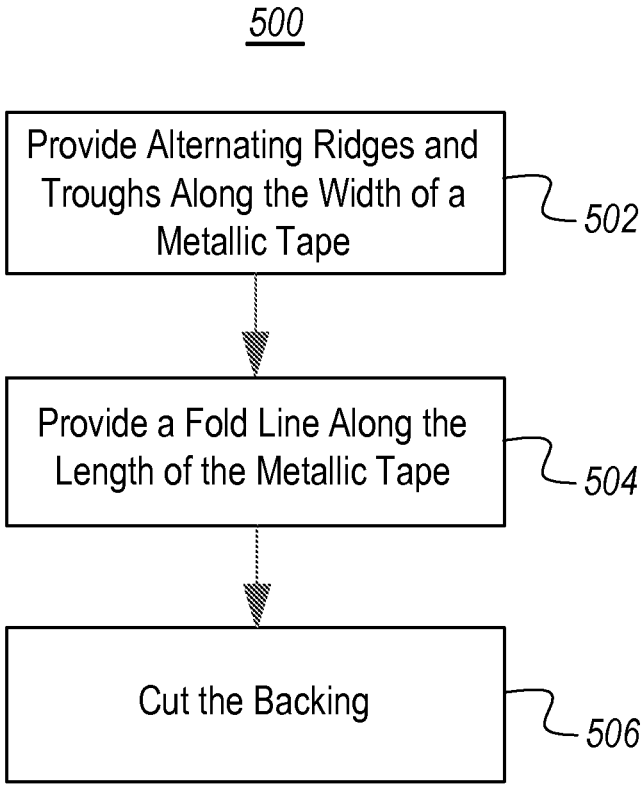
FIG. 5 is a flow chart illustrating a method of preparing a metallic tape for use on a joint.

FIG. 5 is a flow chart illustrating a method 500 of preparing a metallic tape for use on a joint. One of skill in the art will appreciate that the method 500 can be used to prepare the metallic tape using the system 100 of FIG. 1; however, the method 500 can be used to prepare a metallic tape using a system other than the system 100 of FIG. 1.

FIG. 5 shows that the method 500 can include providing alternating ridges and troughs along the width of a metallic tape 502. In at least one implementation, the ridges and troughs allow the tape a great deal of flexibility. In particular, certain sections of the metallic tape can be lengthened, while others are unaffected. For example, the outer section can spread or "fan" by flattening the ridges allowing the tape to curve. Where the ridges remain, the adhesive of the metallic tape can attach the "inside" of the ridge to itself. I.e., an ascending side of the ridge can be attached to the descending side of the ridge. This can produce at tight seal, even where the metallic tape is not spread.

In at least one implementation, the metallic tape can pass through the clearance between a first gear and a second gear. In particular, the rotation of the first gear can pinch the metallic tape, producing the desired corrugations. The force of the metallic tape passing through the clearance between the first gear and the second gear can rotate the first gear and the second gear. Additionally or alternatively, the turning mechanism can rotate the first gear and/or the second gear which pulls the metallic tape through the slot and past the cutting mechanism.

In at least one implementation, the first gear can include a wheel or shaft with teeth or cogs extending from the outer surface at regular intervals. The teeth can produce the corrugations in the metallic tape, as described above. The first gear can be mounted on a body. The first gear can be made of any suitable material. For example, the first gear can be made of wood, metal, plastic or any other suitable material.

In at least one implementation, the second gear can be mounted on the body and can mate with the first gear. The pressure of the first gear mating with the second gear can form corrugations along the metallic tape. I.e., metallic tape inserted between the first gear and the second gear can be reshaped, such that the metallic tape becomes corrugated, as described above. The second gear can be made of any suitable material, such as the same material as the first gear. Additionally or alternatively, the second gear can be made of different material that the first fear.

One of skill in the art will appreciate that mating between the first gear and the second gear need not include the teeth of the first gear interacting with the teeth of the second gear, either directly or indirectly. I.e., the outside circle of the first gear need not intersect the outer circle of the second gear. However, the first gear and second gear can be aligned such that if the outside circle of the first gear did intersect the outer circle of the second gear, then the teeth of the first gear and the second gear would mesh In at least one implementation, the clearance between the first gear and the second gear can be sufficient to accommodate the metallic tape. As used herein the clearance between the first gear and the second gear can be the closest distance between the root circle (i.e., the circle circumscribed by the base of the teeth) of the first gear and the root circle of the second gear. I.e., the clearance between the first gear and the second gear can be the distance from the center of the first gear to the center of the second gear minus the root radius of the first gear and the root radius of the second gear. The clearance can be a fixed distance or can be determined by a force that forces the first gear and the second gear toward one another. For instance, the clearance between the first gear and the second gear can be between 0.01 inches and 0.02 inches. In particular, the clearance between the first gear and the second gear can be approximately 0.015 inches.

In at least one implementation, the diameter of the first gear and the second gear can be any convenient value to create the proper circular pitch. In particular, the circular pitch is the distance from one face of a tooth to the corresponding face of an adjacent tooth on the same gear. The circular pitch can determine the distance between adjacent troughs in the corrugated metallic tape. For example, the circular pitch of the first gear and/or the second gear can be between 0.1 inches and 0.2 inches. In particular, the circular pitch of the first gear and/or the second gear can be approximately 0.15 inches.

In at least one implementation, the body can be used to guide the metallic tape. In particular, the body can ensure that the tape is aligned properly in order to ensure that the corrugations are along the width of the metallic tape. Additionally or alternatively, the body can be used to secure the other portions of the system. The body can be made of any suitable material. For example, the body can be made of wood, metal, plastic or any other suitable material.

In at least one implementation, the body can include a slot. The slot can be configured to receive the metallic tape. In particular, the slot can position the metallic tape so that the cutting mechanism cuts the backing of the metallic tape at the proper position. Additionally or alternatively, the slot can position the metallic tape to be properly aligned relative to the first gear and the second gear.

In at least one implementation, a turning mechanism can be attached to the first gear. I.e., the turning mechanism can be used to turn the first gear. The mating of the first gear and the second gear can impart the rotational force applied by the turning mechanism applied to the first gear to the second gear, turning the second gear. Additionally or alternatively, the turning mechanism can be attached to the second gear for turning the second gear.

One of skill in the art will appreciate that the turning mechanism can include any mechanism, device or apparatus which provides rotational force. For example, the turning mechanism can include an arm and handle. Additionally or alternatively, the turning mechanism can include a motor. A motor includes any device capable or transforming electrical or mechanical energy into rotational force.

FIG. 5 also shows that the method 500 can include providing a fold line along the length of the metallic tape 504. In at least one implementation, the first gear and/or the second gear can include an interior portion which is smooth. I.e., the first gear and/or the second gear can include an interior portion which lacks teeth. For example, the interior portion 108 can include an area where the teeth are completely lacking. Additionally or alternatively, the interior portion 108 can include a filling that prevents corrugations from forming or flattens the corrugations as they form. For example, the interior portion 108 can include cork, rubber, plastic or other material. The filling can fill a only a portion of the interior portion 108, allowing the first gear 104 and the second gear 106 to continue to rotate relative to one another. For example, the filling can occupy approximately 50 percent of the gap between the bottom of the teeth and the top of the teeth.

One of skill in the art will appreciate that the interior portion can be at the midpoint of the first gear and/or the second gear. In at least one implementation, the smooth interior portion can be used to produce a fold line in the metallic tape, as described above. The interior portion of the first gear and the interior portion of the second gear can be opposite one another.

One of skill in the art will appreciate that the first gear and/or the second gear can each include one or more gears combined, such that the junction between gears forms the interior portion. I.e., the interior portion can be a junction between gears, rather than a portion of a single gear which lacks teeth.

FIG. 5 further shows that the method 500 can include cutting the backing 506. In at least one implementation, cutting the backing can include at least partially cutting through the backing on the metallic tape. The backing can be cut along the fold line. In particular, the backing can be cut to produce a first section and a second section which are on opposite sides of the fold line. I.e., the first section can be removed, allowing the metallic tape on that side of the fold line to be applied to the desired surface while the second section can be used to protect the adhesive on the portion of the metallic tape that is not ready to be used.

In at least one implementation, cutting the backing 506 can be done with a cutting mechanism. In at least one implementation, the cutting mechanism is attached to the body and is configured to at least partially cut through the backing of the metallic tape. Partially or completely cutting through the backing of the metallic tape can allow the backing to be removed, even when the tape has been folded, as described above.

In at least one implementation, the cutting mechanism can include a blade. For example, the blade can include a flat cutting surface. In particular, the blade can be the portion of the cutting mechanism which cuts through the backing of the metallic tape. One of skill in the art will appreciate that the blade can be mounted directly on the first gear or the second gear. For example, the blade can be mounted on the smooth interior portion.

In at least one implementation, the cutting mechanism can include an adjustment mechanism. The adjustment mechanism can be used to adjust the position of the blade relative to the metallic tape as it passes through the system. I.e., if the adjustment mechanism can move the position blade to ensure that the blade neither cuts the backing too deeply nor too shallowly. For example, the adjustment mechanism can include a spring, bolt and thumbnut.

One skilled in the art will appreciate that, for this and other processes and methods disclosed herein, the functions performed in the processes and methods may be implemented in differing order. Furthermore, the outlined steps and operations are only provided as examples, and some of the steps and operations may be optional, combined into fewer steps and operations, or expanded into additional steps and operations without detracting from the essence of the disclosed embodiments.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A method of preparing a metallic tape for use on a joint, the method comprising:

providing a metallic tape, wherein the metallic tape includes:

a metallic carrier material;

an adhesive layer applied to the metallic carrier material; and a backing, wherein the backing material is configured to protect the adhesive layer until use;

feeding the metallic carrier material, adhesive layer, and backing, between first and second gears each being rotatably mounted to a body to be rotatable about an axis of rotation and mated with one another and each having a left side toothed portion, a right side toothed portion, and an interior portion between the right and left side toothed portions, the interior portion of both the first and second gears lacking teeth and defining a circle about the axis of rotation, the feeding the metallic carrier material and adhesive layer between the first and second gears effective to create alternating ridges and troughs along the width of the metallic tape and create a fold line along the length of the metallic tape without cutting the metallic tape and without folding the metallic tape along the fold line, wherein the fold line includes an area where the alternating ridges and troughs are flattened approximately 50 percent relative to the depth of the alternating ridges and troughs; and feeding the metallic carrier material, adhesive layer, and backing past a stationary cutting tool affixed to the body and positioned adjacent the first and second gears effective to create a cut in the backing, wherein cutting the backing includes at least partially cutting through the backing on the metallic tape without cutting through the metallic tape;

wherein feeding the metallic carrier material, adhesive layer, and backing between the first and second gears occurs after feeding the metallic carrier, adhesive layer, and backing past the cutting tool such that the cut line is positioned over the fold line.

2. The method of claim 1, wherein the first gear is turned moving the metallic tape through the partial mating of the first gear with the second gear.

3. The method of claim 1, wherein the interior portion includes cork.

4. The method of claim 1, wherein the interior portion includes rubber.

5. The method of claim 1, wherein the interior portion includes plastic.

6. The method of claim 1, wherein the fill material occupies approximately 50 percent of the gap between the bottom of the teeth and the top of the teeth in the first gear and the second gear.

7. The method of claim 1, wherein the cut does not pass through any portion of the metallic carrier material.

8. The method of claim 1, wherein the cut does not pass through any portion of the adhesive.

* * * * *